US010348029B2

(12) United States Patent
Flender et al.

(10) Patent No.: US 10,348,029 B2
(45) Date of Patent: Jul. 9, 2019

(54) MODULAR ELECTRICAL CONNECTOR ASSEMBLY AND ASSOCIATED METHOD OF MAKING

(71) Applicant: AVX Corporation, Fountain Inn, SC (US)

(72) Inventors: Martin Flender, Kreuztal (DE); Gert Krah, Hattert (DE); Christian Glaß, Rennerod (DE); Martin Fuchs, Betzdorf (DE)

(73) Assignee: AVX CORPORATION, Fountain Inn, SC (US)

( * ) Notice: Subject to any disclaimer, the term of this patent is extended or adjusted under 35 U.S.C. 154(b) by 0 days.

(21) Appl. No.: 15/632,861

(22) Filed: Jun. 26, 2017

(65) Prior Publication Data

US 2017/0294735 A1 Oct. 12, 2017

Related U.S. Application Data

(63) Continuation of application No. 15/157,735, filed on May 18, 2016, now Pat. No. 9,705,234, which is a (Continued)

(51) Int. Cl.
*H01R 13/514* (2006.01)
*H01R 13/518* (2006.01)

(Continued)

(52) U.S. Cl.
CPC ..... *H01R 13/514* (2013.01); *H01R 12/716* (2013.01); *H01R 13/04* (2013.01);

(Continued)

(58) Field of Classification Search
CPC ..... H01R 13/04; H01R 13/40; H01R 13/502; H01R 27/00; H01R 43/20; H01R 2107/00;

(Continued)

(56) References Cited

U.S. PATENT DOCUMENTS 3,711,817 A 1/1973 Carter et al.
3,753,212 A 8/1973 Yamada et al.

(Continued)

FOREIGN PATENT DOCUMENTS

CN 201270314 Y 7/2009
CN 201805080 U 4/2011

(Continued)

OTHER PUBLICATIONS

Communication issued on EP Application 14151473.7, dated Jul. 13, 2016.

(Continued)

*Primary Examiner* — Edwin A. Leon

(74) *Attorney, Agent, or Firm* — Foley & Lardner LLP

(57) ABSTRACT

A method for producing modular electrical connectors having varying contact element configurations includes providing a common header component having a plurality of receptacle spaces defined therein. A plurality of different contact sub-assemblies are provided having varying contact element configurations, with each of sub-assembly having a common size configured for receipt in the receptacle spaces. A pattern of the contact sub-assemblies is defined for a particular desired connector configuration from any combination of the contact sub-assemblies, and the contact sub-assemblies are fitted and adhered into the receptacle spaces in the header component according to the pattern. A kit may be provided with the modular components for making the connectors.

23 Claims, 5 Drawing Sheets

Related U.S. Application Data continuation of application No. 14/725,056, filed on May 29, 2015, now Pat. No. 9,362,694, which is a continuation of application No. 13/752,478, filed on Jan. 29, 2013, now Pat. No. 9,048,560.

(51) Int. Cl.

| | |
|---|---|
| ***H01R 43/20*** | (2006.01) |
| ***H01R 43/00*** | (2006.01) |
| ***H01R 12/71*** | (2011.01) |
| ***H01R 24/68*** | (2011.01) |
| ***H01R 43/18*** | (2006.01) |
| ***H01R 13/04*** | (2006.01) |
| ***H01R 13/40*** | (2006.01) |
| ***H01R 13/502*** | (2006.01) |
| ***H01R 27/02*** | (2006.01) |
| ***H01R 27/00*** | (2006.01) |
| *H01R 13/504* | (2006.01) |
| *H01R 107/00* | (2006.01) |

(52) U.S. Cl.

CPC ..... *H01R 13/40* (2013.01); *H01R 13/502* (2013.01); *H01R 13/518* (2013.01); *H01R 24/68* (2013.01); *H01R 27/00* (2013.01); *H01R 27/02* (2013.01); *H01R 43/00* (2013.01); *H01R 43/18* (2013.01); *H01R 43/20* (2013.01); *H01R 13/504* (2013.01); *H01R 2107/00* (2013.01); *Y10T 29/49208* (2015.01)

(58) Field of Classification Search

CPC .. H01R 13/514; H01R 13/504; H01R 13/518; H01R 43/00; Y10T 29/49208

USPC .... 439/166, 170, 171, 174, 175, 701, 540.1, 439/572, 686, 587, 695; 29/876

See application file for complete search history.

(56) References Cited

U.S. PATENT DOCUMENTS

| | | | | |
|---|---|---|---|---|
| 5,328,388 | A | 7/1994 | Fust et al. | |
| 6,210,218 | B1 * | 4/2001 | Chang | H01R 12/7029 439/567 |
| 6,413,119 | B1 | 7/2002 | Gabrisko et al. | |
| 6,520,810 | B1 | 2/2003 | Lepottier et al. | |
| 6,540,559 | B1 * | 4/2003 | Kemmick | H01R 23/688 439/108 |
| 6,719,573 | B2 * | 4/2004 | Koehler | H01R 12/585 29/837 |
| 6,860,741 | B2 | 3/2005 | Ashman et al. | |
| 6,935,902 | B1 | 8/2005 | Chou | |
| 7,438,591 | B2 | 10/2008 | Chen et al. | |
| 8,007,308 | B2 | 8/2011 | Feldman et al. | |
| 8,206,185 | B2 | 6/2012 | Jehmlich et al. | |
| 9,048,560 | B2 * | 6/2015 | Flender | H01R 13/514 |
| 9,362,694 | B2 | 6/2016 | Flender et al. | |
| 9,705,234 | B2 * | 7/2017 | Flender | H01R 13/514 |
| 2003/0016242 | A1 | 1/2003 | Ramahefarivony et al. | |
| 2003/0162421 | A1 | 8/2003 | Pratt et al. | |
| 2005/0122694 | A1 | 6/2005 | Kane | |
| 2006/0134956 | A1 | 6/2006 | Freimuth et al. | |
| 2007/0264867 | A1 | 11/2007 | Harmelink et al. | |

FOREIGN PATENT DOCUMENTS

| | | |
|---|---|---|
| DE | 10 2004 060 302 A1 | 7/2005 |
| EP | 1 033 787 | 9/2000 |
| WO | WO-2012/130537 | 10/2012 |
| WO | WO-2013/029892 | 3/2013 |

OTHER PUBLICATIONS

Extended Search Report received in European Patent Application No. 14151473.7-1801 dated Apr. 25, 2014 (11 pages).

Non-Final Office Action received in U.S. Appl. No. 13/752,478 dated Oct. 22, 2014, 11 pages.

Notice of Allowance received in U.S. Appl. No. 13/752,478 dated Feb. 20, 2015, 8 pages.

U.S. Final Office Action for U.S. Appl. No. 14/725,056 dated Nov. 17, 2015.

U.S. Non-Final Office Action for U.S. Appl. No. 14/725,056 dated Sep. 15, 2015 (11 pages).

U.S. Notice of Allowance for U.S. Appl. No. 14/725,056 dated Mar. 18, 2016 (11 pages).

U.S. Office Action on U.S. Appl. No. 15/157,735 dated Oct. 5, 2016 (10 pages).

First Office Action received in CN2016104906724 dated Mar. 21, 2018, with English translation (16 pages).

Office Action received in European Patent Application No. 17173692.9 dated Oct. 1, 2018 (6 pages).

* cited by examiner

MODULAR ELECTRICAL CONNECTOR ASSEMBLY AND ASSOCIATED METHOD OF MAKING

CROSS-REFERENCE TO RELATED APPLICATIONS

The present application is a continuation of U.S. patent application Ser. No. 15/157,735, filed May 18, 2016 (now U.S. Pat. No. 9,705,234), which is a continuation of U.S. patent application Ser. No. 14/725,056, filed May 29, 2015 (now U.S. Pat. No. 9,362,694), which is a continuation of U.S. patent application Ser. No. 13/752,478 (now U.S. Pat. No. 9,048,560), filed Jan. 29, 2013, the contents of each of which are incorporated by reference in their entireties into the present disclosure.

FIELD OF THE INVENTION

The present invention relates generally to the field of electrical connectors, and more particularly to a modular electrical connector assembled from interchangeable components.

BACKGROUND

As electrical connectors grow more complex, the associated manufacturing costs and assembly time increase correspondingly. This is particularly true for high pin count "pin header" connectors of the type illustrated in FIGS. 1A and 1B. These pin header connectors are male connector components with one or more rows of contact pins and are typically used inside of electronic components, for example to connect to a ribbon cable connector. Pin headers may be through-hole mount devices with straight pins that are press-fitted into a mating component, or surface mount technology (SMT) devices having solder dip pins ("tails") bent at a ninety-degree angle for soldering to a solder plane on a printed circuit board (PCB) or other component. The pin headers may also be THT (through hole technology) devices, PIP (in in paste) devices, as well as solder versions. Pin headers can be straight or angled, with the angled version typically used to connect adjacent PCB's together. Pin headers of the type depicted in FIGS. 1A and 1B having a plastic guide box around the pin rows are often referred to as "box headers" or "shrouded headers."

Conventional pin headers are generally produced in a one-step process wherein the pins are "stitched" into the front face or plate of a unitary insulative header component. Thus, different variations of pin headers require unique tooling and, as the pin count and types/arrangement of pins grow, so do the tooling and assembly requirements/costs. For example, a 64-pin count box header may be manufactured with straight or right-angle solder tail pins, or with different spacing between pins, or any number of other contact element variations. The tooling and assembly costs for these different variations can be quite significant.

The present invention provides a modular alternative to conventional pin header connectors (and associated assembly process) that is cost effective and provides manufacturing flexibility to accommodate different variations of connectors.

SUMMARY

Objects and advantages of the invention will be set forth in part in the following description, or may be obvious from the description, or may be learned through practice of the invention.

In accordance with aspects of the invention, a method is provided for producing electrical connectors having varying contact element configurations. The method includes providing a common insulative material header component having a plurality of receptacle spaces defined therein. A plurality of different contact sub-assemblies are provided, with the sub-assemblies having varying (e.g., different) contact element configurations. Each of the contact sub-assemblies has a common perimeter size designed such that the sub-assemblies can be received in any one of the receptacle spaces. A pattern of the contact sub-assemblies is defined from any combination of the contact sub-assemblies for a particular desired connector configuration, and the defined contact sub-assemblies are fitted into the receptacle spaces in the header component according to the pattern. The contact sub-assemblies are fixed relative to the header component by any suitable attachment means, such as gluing (e.g., adhering), welding, mechanical attachment, and so forth.

In a particular embodiment, the varying contact sub-assemblies have any combination of different number, size, or arrangement of contact elements between different types of the sub-assemblies.

It should be appreciated that the various method embodiments are not limited to any particular type of connector or contact element configuration. In a particular embodiment, the method is suited for producing a pin header connector, and the different contact sub-assemblies have a different number, size, or arrangement of contact pins configured on a pin plate. The contact pins may be a straight pin or angled pin configuration, and may include one or more rows of the pins. In still another embodiment, the pin header connector is a box header connector with each receptacle space defined by a box-shaped receptacle. With this embodiment, the method further includes fitting the contact sub-assemblies into the box-shaped receptacles and gluing a pin plate of the sub-assemblies to a front face of the box-shaped receptacle, for example directly onto the front face or within a recess or groove defined in the front face.

In a different embodiment, the plurality of contact sub-assemblies includes multiple ones of the same type of contact sub-assembly and the pattern of contact sub-assemblies in the final connector includes only the same type of contact sub-assemblies in the receptacle spaces in the header component. In an alternate embodiment, the pattern of contact sub-assemblies includes at least two different types of contact sub-assemblies in the receptacle spaces in the header component. In still a further embodiment, the pattern of contact sub-assemblies includes at least one empty receptacle space in the header component.

Various method embodiments may include providing a plurality of different header components having a varying number of receptacle spaces, wherein the pattern for the particular desired connector configuration includes any combination of the different contact sub-assemblies in any one of the different header components.

The present invention also encompasses a modular electrical connector assembly kit, wherein the kit may be used to produce different electrical connectors having varying contact element configurations. In a particular embodiment, the kit includes a common insulative material header component having a plurality of receptacle spaces defined therein, as well as a plurality of different contact sub-assemblies having varying contact element configurations. Each of the contact sub-assemblies has a common size configured for receipt in any one of the receptacle spaces. The contact sub-assemblies include an insulative base component, with the contact elements retained in the base component and the base component defining a first mating surface. Each of the receptacle spaces includes a second mating surface disposed so as to face the first mating surface of the contact sub-assemblies. With the various components of the kit, a particular desired connector configuration can be formed from any combination of the contact sub-assemblies fitted into any combination of the receptacle spaces and gluing the first and second mating surfaces together.

In a particular kit embodiment, the different contact sub-assemblies have any combination of varying number, size, or arrangement of contact elements.

Various embodiments of the kit may be particularly configured for producing a pin header connector, with the different contact sub-assemblies having any combination of varying number, size, or arrangement of contact pins extending through a pin plate. The pin header connector may be a box header connector, wherein each receptacle space includes a box-shaped receptacle extending rearward from a front plate.

In various embodiments, the header component may include a front plate, with the second mating surface defined on the front plate around the receptacle. In an alternate embodiment, the second mating surface is defined in a recess or groove in the front plate around the receptacle such that the contact sub-assemblies mount flush with the front plate. In still a further embodiment, the first and second mating surfaces are defined by the circumferential edge of the contact sub-assemblies and edge of the receptacle space.

Embodiments of the kit may be provided with a plurality of the same type of contact sub-assemblies such that the desired connector configuration may include only the same type of contact sub-assemblies in respective receptacle spaces in the header component.

The kit may include a header component having a greater number of receptacle spaces than are needed for a particular desired connector configuration such that at least one empty receptacle space is left in the header component.

Embodiments of the kit may include a plurality of different header components having a varying number of receptacles, wherein the particular desired connector configuration includes any combination of the same or different contact sub-assemblies in any one of the different header components.

The present invention also encompasses various embodiments of a modular connector having an insulative material header component with a plurality of receptacle spaces defined therein. A plurality of contact sub-assemblies are fitted into respective ones of the receptacle spaces, with each of the contact sub-assemblies having an insulative base component and a plurality of contact elements held in the base component. The base component defines a first mating surface. Each of the receptacle spaces includes a second mating surface disposed so as to face the first mating surface of the contact sub-assemblies. The contact sub-assemblies are secured into the receptacle spaces with a glued interface between the first and second mating surfaces.

In a certain embodiment, at least two of the contact sub-assemblies are different in that they have any combination of varying number, size, or arrangement of contact elements. In an alternate embodiment, all of the contact sub-assemblies are the same and have the same number, size, and arrangement of contact elements.

As mentioned above, the connector is not limited to any particular type or intended purpose. In one embodiment, the connector is a pin header connector and the base component includes a pin plate through which a plurality of contact pins are received. The pin header connector may, in certain embodiments, be a box header connector, with each receptacle space having a box-shaped receptacle extending rearward from a front plate.

Various other embodiments of the modular connector may include any features discussed above and described in greater detail herein.

Particular embodiments of the unique modular connector and method for making are described in greater detail below by reference to the examples illustrated in the drawings.

DETAILED DESCRIPTION

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

Figure 1A:
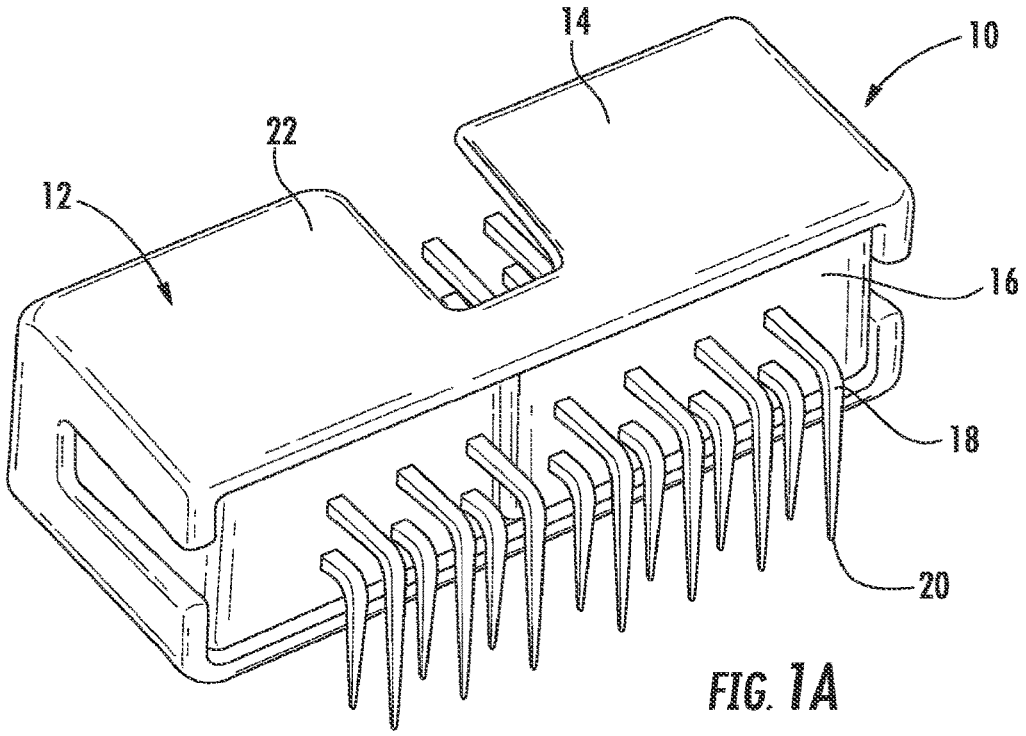
FIG. 1A PRIOR ART
FIG. 1A is a perspective view of an embodiment of a prior art pin header connector.
Figure 1B:
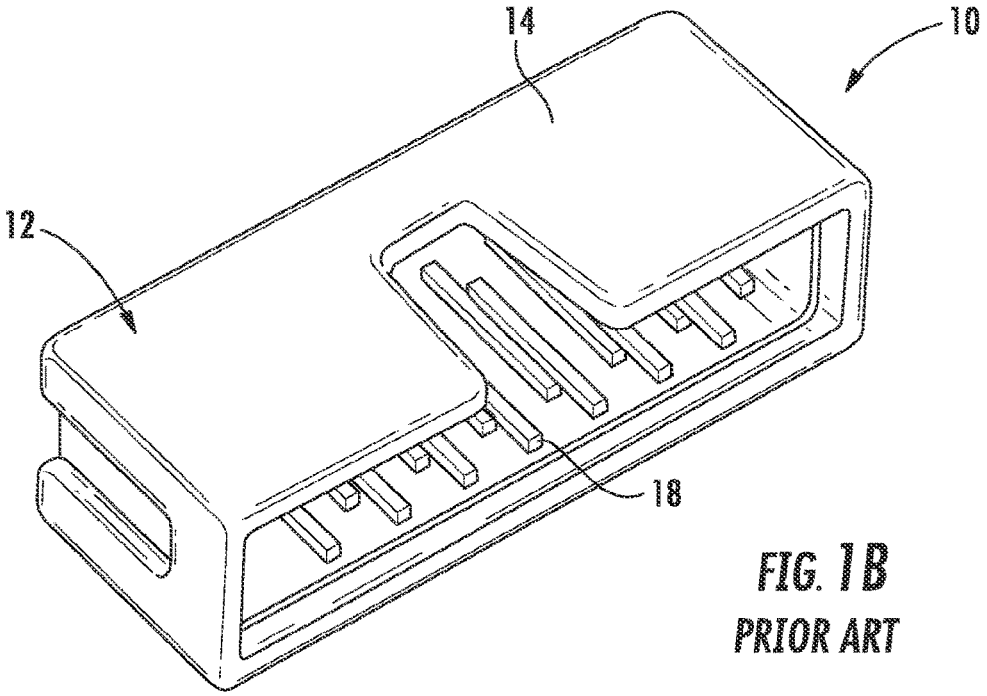
FIG. 1B PRIOR ART
FIG. 1B is an alternate perspective view of the prior art pin header connector of FIG. 1B.

FIGS. 1A and 1B present respective views of a prior art box header connector 10 available from AVX Corporation. As is well known by those skilled in the art, these conventional box header connectors 10 include one or more rows of contact pins 18 received inserted ("stitched") through a front wall or plate 16 of a box-shaped housing 14. In the particular illustrated embodiment, the contact pins 18 are angled pins and include a solder tail 20 for soldering to a solder plane on a PCB or other component, as is known in the art. The box-shaped housing 14 may include an alignment notch 22, and other various features not particularly relevant to the present description. With these conventional connectors 10, the box-shaped housing 14 is a unitary component that is unique for each particular connector configuration. For example, various embodiments of the box header connectors 12 may include a single row of contact ends 18, or a different spacing of the contact pins 18, and so forth. Each of these different configurations generally requires a unique housing 14, as well as associated tooling, and the like.

Referring to the remaining figures in general, various embodiments of connectors 50 in accordance with aspects of the invention are illustrated. These connectors 50 are "modular" connectors in that the connectors are formed by the assembly of modular components, wherein various ones of the components (e.g., connector sub-assemblies) can be interchanged in a common header component to provide different connectors 50 utilizing the common header component, as described in greater detail below.

The various connectors 50 are illustrated and described herein as pin header connectors, particularly box header connectors, for ease of illustration and description purposes. It should be appreciated that the invention is not limited to only pin header connectors. The invention has utility for any type of electrical connector wherein different contact configurations are desired and can be accommodated by mounting modular sub-components on a common housing for the various contact configurations.

Figure 2:
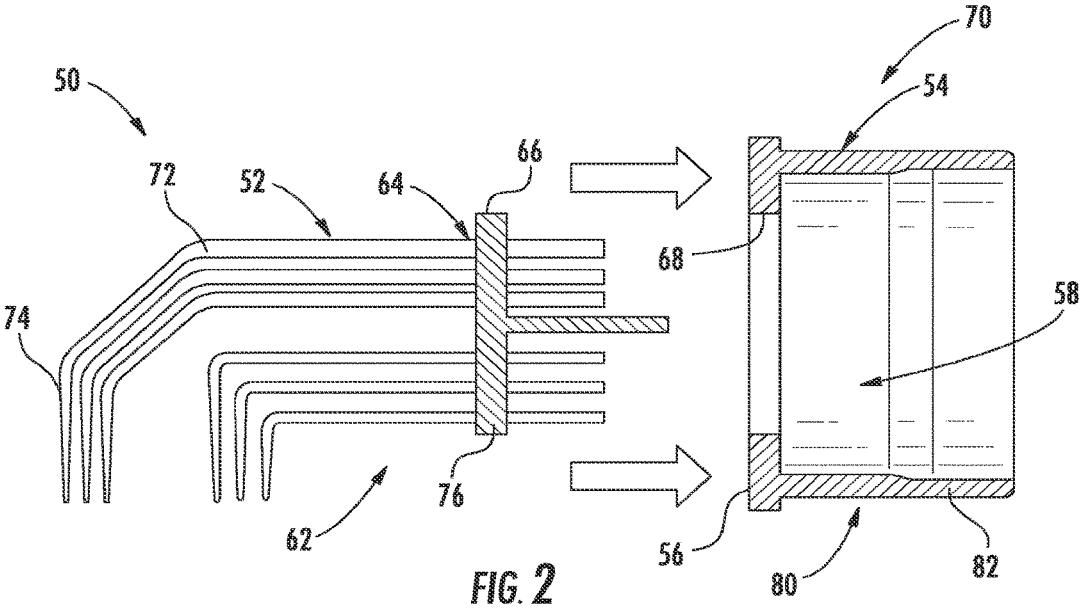
FIG. 2 is side cut-away view of components of a modular connector embodiment in accordance with aspects of the present invention.
Figure 3:
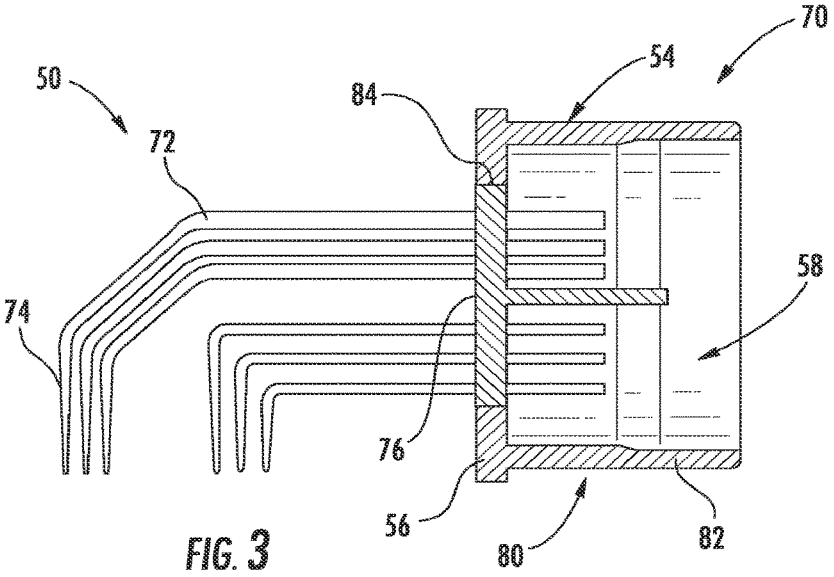
FIG. 3 is a side cut-away view of the components of FIG. 2 in an assembled state.

Referring to FIGS. 2 and 3, modular components of a connector 50 in accordance with aspects of the invention are illustrated. In particular, a common insulative material header component 54 defines a receptacle space 58 therein. The header component 54 and receptacle space 58 may have any shape, size, and configuration depending on the characteristics of the final connector 50, with the header component 54 made from any suitable electrically insulative material, for example a high temperature plastic material such as STANYL high temperature resistant nylon.

Contact sub-assemblies 62 constitute another modular component of the connector 50. Each of the sub-assemblies 62 has a common perimeter size and is configured for receipt in a respective one of the receptacle spaces 58 defined in the header component 54.

Figure 7:
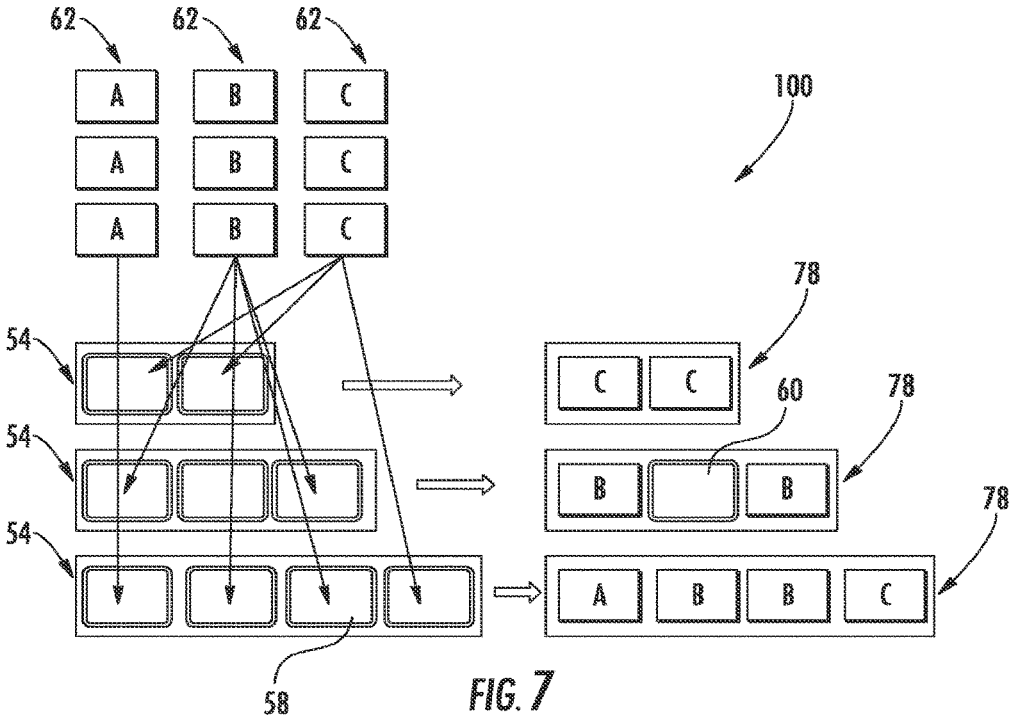
FIG. 7 is a diagrammatic view of an embodiment of a connector kit assembly in accordance with aspects of the invention.

Referring for example to FIG. 7, an assembly method in accordance with aspects of the invention includes providing a plurality of different ones of the contact sub-assemblies 62. For example, a certain group or plurality of the contact sub-assemblies 62 may have a contact configuration "A", while different groups of the contact sub-assemblies 62 may have a contact configuration "B" or "C". Referring to FIGS. 2 and 3, the illustrated contact sub-assemblies 62 include multiple rows of contact elements 52. These contact elements 52 may be, for example, pin contacts 72, blade contacts, strips, or any other type of electrical contact element. The different contact sub-assemblies 62 may have varying numbers, spacing, rows, arrangement, or other configurations of the contact elements 52, as represented by the A, B, and C contact sub-assemblies 62 in FIG. 7.

Figure 4:
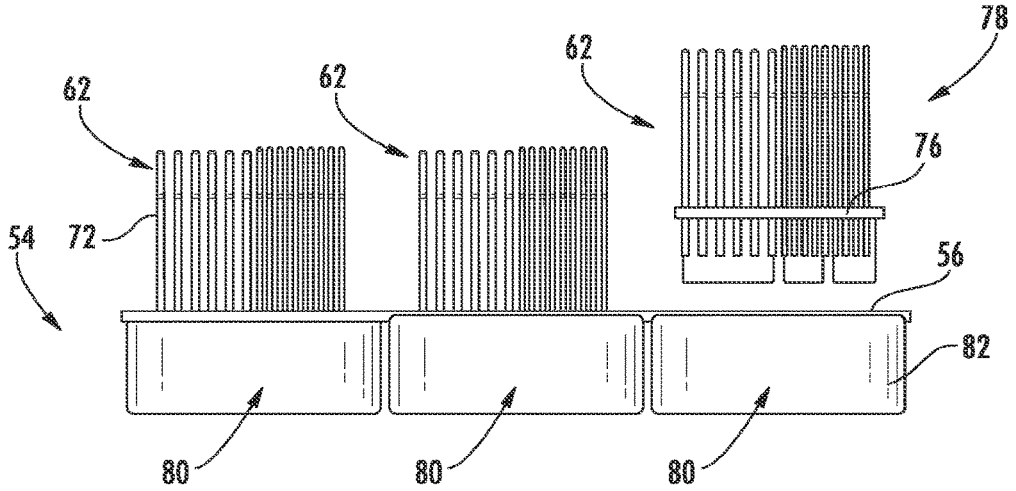
FIG. 4 is a top view of an embodiment of a box header pin connector in accordance with aspects of the invention.
Figure 5:
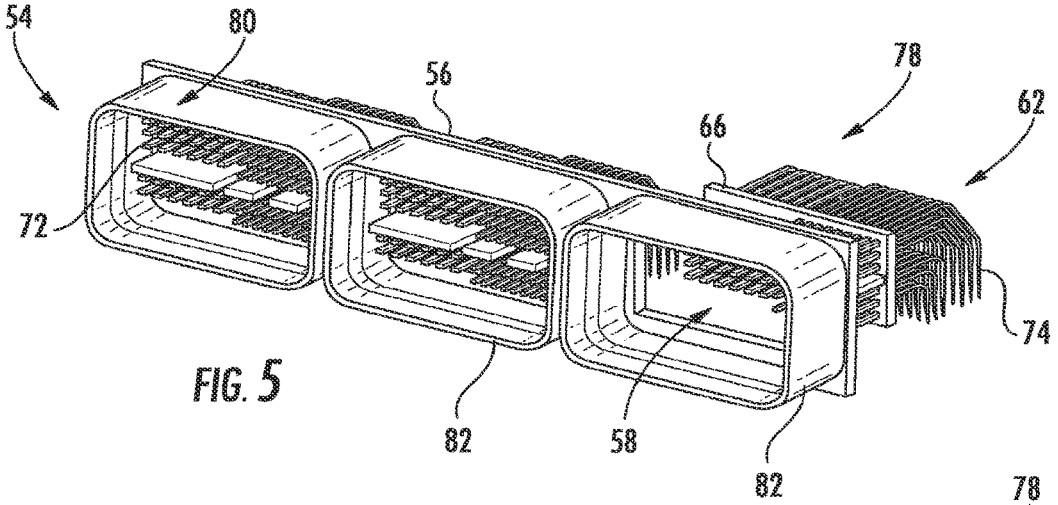
FIG. 5 is a back perspective view of the connector of FIG. 4.
Figure 6:
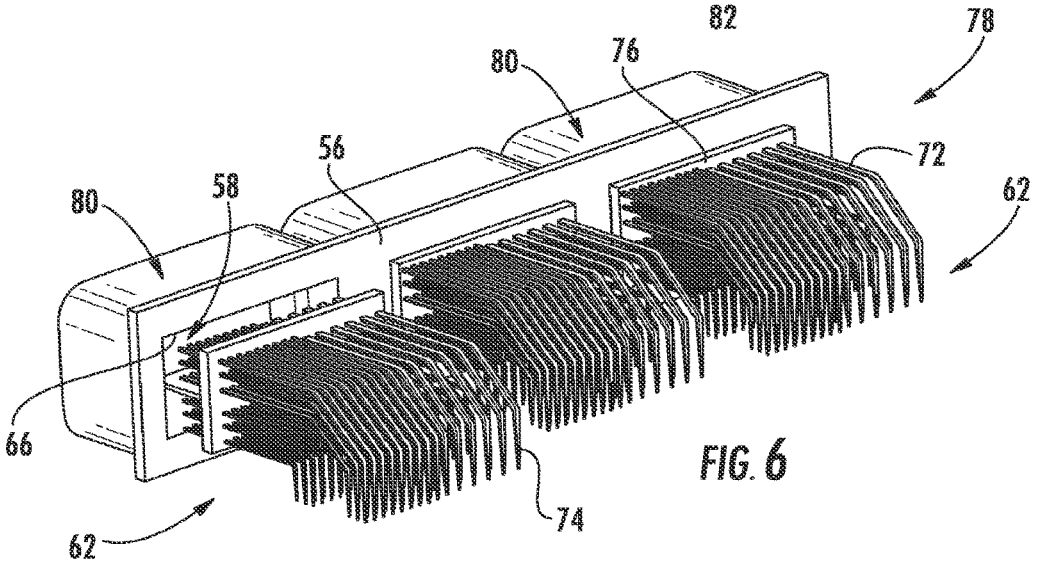
FIG. 6 is a front perspective view of the connector of FIG. 4.

Referring for example to FIGS. 4 through 6, the header component 54 may include a plurality of the receptacle spaces 58 defined therein, with each of the different types of contact sub-assemblies 62 insertable into any one of the receptacle spaces 58. The assembly method includes defining a pattern of the contact sub-assemblies 62 for a particular desired connector configuration from any combination of the contact assemblies 62 (A, B, and C in FIG. 7). Referring to FIGS. 2 through 6, the method includes fitting the respective contact sub-assemblies 62 into the receptacle spaces 58 in the header component 54 according to the design pattern of the overall connector 50. FIG. 2 graphically illustrates insertion of the contact sub-assemblies 62 into the receptacle space 58 in the header component 54, while 53 illustrates the assembled state of the components.

In a particular embodiment in accordance with aspects of the invention, the electrical connector 50 is a pin header connector 70, as illustrated generally in the figures. In a more particular embodiment, the pin header connector 70 is a box header connector 78, as illustrated in FIGS. 4 through 6, with each of the receptacle spaces 58 defined by a multi-sided box-shaped structure 80 with rearwardly projecting walls 82. In these pin header embodiments, the different contact sub-assemblies 62 may have any combination of various number, size, or arrangement of contact pins 72. In the illustrated embodiment, the contact pins 72 are right-angled pins having a solder tail 74. In alternate embodiments, the pin header connectors 70 may have a straight pin configuration.

Referring again to FIGS. 2 and 3, the contact sub-assemblies 62 are securely attached into the receptacle spaces 58 in the header component 54 using any suitable method, such as mechanical devices (e.g., clips, latches, screws, etc.), ultrasonic welding, laser welding, riveting, friction welding, and so forth. In a particular embodiment, the sub-assemblies 62 are attached using a glue, adhesive, binding agent, or the like. Various mating interfaces between the components may be defined for this purpose. For example, in the embodiment depicted in FIGS. 2 and 3, the respective contact sub-assemblies 62 include a base component 64 through which the pins 72 are received. This base component 64 may be a relatively flat pin plate 76 made from any suitable electrically insulative material, for example a high temperature plastic material such as STANYL high temperature resistant nylon. A first mating surface 66 is defined on the pin plate 76 for gluing to a second mating surface 68 defined on the header component 54. In the embodiment depicted in FIGS. 2 and 3, the pin plate 76 has a size so as to frictionally fit within the receptacle space 58 defined in a front plate 56 of the header component 54. Thus, in this particular embodiment, the first mating surface 66 is defined by the peripheral edge of the pin plate 76 and the second mating surface 68 is defined by the inner peripheral edge of the front plate 56 of the header component 54 that defines the receptacle space 58. In the assembled state of the components, glue or adhesive is applied at the interface 84 (FIG. 3) between the pin plate 76 and front plate 56 of the header component 54.

Figure 8:
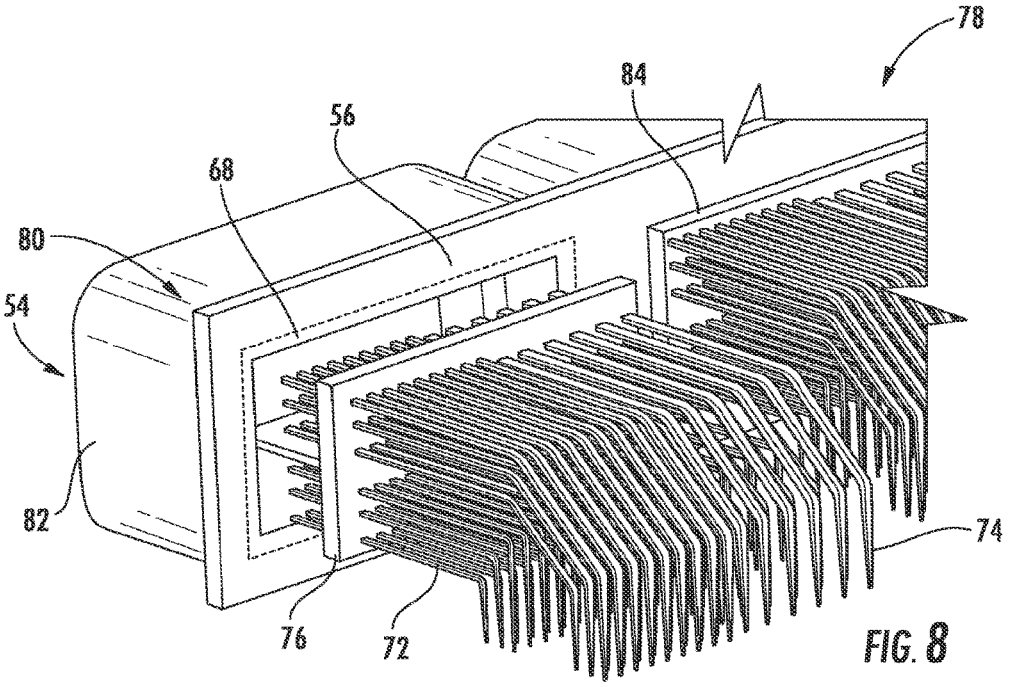
FIG. 8 is a front partial perspective view of an alternate embodiment of a box header connector.

FIG. 8 depicts an alternative embodiment for attaching the contact sub-assembly 62 to the header component 54. In this embodiment, the pin plate 76 is "oversized" in that it extends peripherally beyond the receptacle space 58 and mounts onto the front surface of the front plate 56, for example by gluing or welding. Thus, in this embodiment, the second mating surface 68 is defined by a peripheral portion of the front plate 56 around the receptacle opening 58, and the first mating surface 66 is defined by a back peripheral edge of the pin plate 76.

Figure 9:
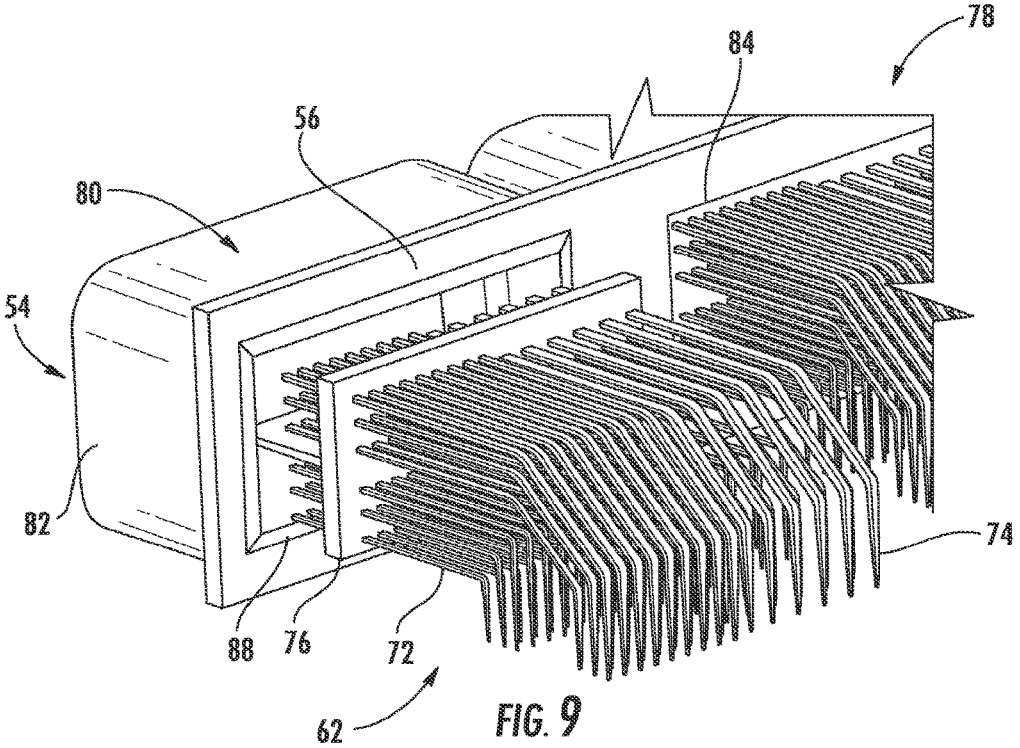
FIG. 9 is a front partial perspective view of still another embodiment of a box header connector.

FIG. 9 depicts an alternative embodiment for mounting the contact sub-assembly 62 within the receptacle space 58 of the header component 54. In this embodiment, the pin plate 76 fits into a groove or recess 88 defined in the front plate 56. Thus, the second mating surface 68 in this embodiment is defined by the surfaces defining the sides and forward edge of the groove 88, and the first mating surface 66 is defined by a back peripheral edge of the pin plate 76. Glue or adhesive may be provided between these mating surfaces to define the glued interface 84.

FIG. 7 depicts an embodiment of a kit 100 for assembly of a modular electrical connector, as well as illustrating principles of various assembly methods in accordance with aspects of the invention. Referring to FIG. 7, the kit 100 includes a plurality of different contact sub-assemblies 62 having varying contact element configurations, as discussed above. Each of the contact sub-assemblies 62 has a common size configured for receipt in any one of the receptacle spaces 58 in one of the header components 54. Each of the contact sub-assemblies 62 includes an insulative base component 64 (FIG. 2) and contact elements such as pins 72 (FIG. 2) held in the base component. As discussed above, the base components 64 define a first mating surface 66 for a glued interface with the header component 54. Each of the receptacle spaces 58 in a header component 54 includes a second mating surface 68 disposed so as to face the first mating surface 66 of a contact sub-assembly 62 to form an attachment interface 84 therewith, as discussed above. With the kit 100 depicted in FIG. 7, a particular desired connector configuration is formable from any combination of the different contact sub-assemblies 62 (A, B, and C) fitted into any combination of receptacle spaces 58 of any one of the header components 54.

In a particular embodiment of the kit 100, a plurality of different types of header components 54 is also provided, wherein the header components 54 have a varying number of receptacle spaces 58 defined therein. For example, in FIG. 7, three different types of header components 54 are provided having two, three, and four receptacle spaces 58, respectively. Thus, a far greater number of different connector configurations are available with the different types of header components 54.

Still referring to FIG. 7, in one particular embodiment, the final connector (box header connector 78) may include only sub-assemblies of the same type, as depicted in the first connector 78 where only type "C" contact sub-assemblies 68 are contained in the final connector.

In an alternative embodiment, the final connector 78 may include at least two different types of the contact sub-assembly 62, as depicted by the third version of the box header connector 78 depicted in FIG. 7.

In an alternative embodiment, the header component 54 may include a greater number of receptacle spaces 58 then is required for a particular connector configuration. In this embodiment, the final connector 78 may include an empty receptacle 60, as depicted by the second box header connector 78 in FIG. 7. Thus, it should be appreciated that the header component 58 having, for example, three receptacle spaces 58 may be used to manufacture a final connector having only a single connector sub-assembly 62, two connector sub-assemblies 62, or three connector sub-assemblies 62. Thus, a single common header component 54 may be used in these various connector configurations and provides greater manufacturing flexibility and reduced overall tooling and component costs.

It should be appreciated that the present invention also encompasses any type of electrical connector 50, 70, 78 made in accordance with aspects of the invention described herein.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. A method for producing an electrical connector, comprising:

inserting a first modular contact assembly into a first receptacle space of a header component, the first receptacle space defined by a first box-shaped receptacle comprising a plurality of projecting walls, wherein the first modular contact assembly comprises a first pin plate having a first planar surface and a second planar surface, wherein the first planar surface is parallel to the second planar surface, and wherein a first plurality of contact elements extends through both the first planar surface and the second planar surface of the first modular contact assembly;

securing the first planar surface of the first pin plate of the first modular contact assembly to a surface of the header component;

inserting a second modular contact assembly into a second receptacle space of the header component to create a desired contact pattern in combination with the first modular contact assembly, the second receptacle space defined by a second box-shaped receptacle comprising a plurality of projecting walls, wherein the second modular contact assembly comprises a second pin plate having a third planar surface and a fourth planar surface, wherein the third planar surface is parallel to the fourth planar surface, and wherein a second plurality of contact elements extends through both the third planar surface and the fourth planar surface of the second modular contact assembly; and securing the third planar surface of the second pin plate of the second modular contact assembly to the surface of the header component.

2. The method of claim 1, wherein the first modular contact assembly and the second modular contact assembly each have a different number, size, or arrangement of contact elements.

3. The method of claim 2, wherein the electrical connector is a pin header connector, and wherein the first modular contact assembly and the second modular contact assembly each have a different number, size, or arrangement of contact pins configured on respective pin plates.

4. The method of claim 3, the method further comprising fitting the first modular contact assembly and the second modular contact assembly into the first box-shaped receptacle and the second box-shaped receptacle and adhering the first and second pin plates to a front face of each of the first box-shaped receptacle and the second box-shaped receptacle, respectively.

5. The method of claim 1, wherein the header component comprises a third receptacle space defined by a third box-shaped receptacle comprising a plurality of projecting walls.

6. The method of claim 5, wherein each of the first, second, and third receptacle spaces have a common perimeter size.

7. The method of claim 5, wherein the desired contact pattern includes the third receptacle space left unfilled with a module contact assembly.

8. The method of claim 5, further comprising inserting a third modular contact assembly into the third receptacle space of the header component, wherein the third modular contact assembly has a same perimeter size and a different contact element configuration from the first and second modular contact assemblies, and wherein the desired contact pattern comprises a combination of the first, second and third modular contact assemblies.

9. The method of claim 1, further comprising providing a plurality of different header components having a varying number of receptacle spaces between different header components, wherein the desired contact pattern includes a combination of modular contact assemblies in at least one of the different header components, and wherein the first and second modular contact assemblies are interchangeable in the first and second receptacle spaces.

10. The method of claim 1, wherein the first modular contact assembly and the second modular contact assembly have a same perimeter size and different contact element configurations.

11. A modular electrical connector assembly kit comprising;

a header component having a first receptacle space defined by a first box-shaped receptacle comprising a plurality of projecting walls and a second receptacle space defined by a second box-shaped receptacle comprising a plurality of projecting walls;

a first modular contact assembly configured for placement within either the first receptacle space or the second receptacle space of the header component, wherein the first modular contact assembly comprises a first pin plate having a first planar surface and a second planar surface, wherein the first planar surface is parallel to the second planar surface, and wherein a first plurality of contact elements extends through both the first planar surface and the second planar surface of the first modular contact assembly; and a second modular contact assembly configured for placement within either the first receptacle space or the second receptacle space of the header component, wherein the first modular contact assembly and the second modular contact assembly have different contact element configurations, wherein the second modular contact assembly comprises a second pin plate having a third planar surface and a fourth planar surface, wherein the third planar surface is parallel to the fourth planar surface, and wherein a second plurality of contact elements extends through both the third planar surface and the fourth planar surface of the second modular contact assembly.

12. The modular electrical connector assembly kit of claim 11, wherein the first and second modular contact assemblies have a combination of different number, size, or arrangement of contact elements, and wherein the first receptacle space extends entirely through the header component, and wherein the header component defines a perimeter of the first receptacle space.

13. The modular electrical connector assembly kit of claim 11, wherein the first and second modular contact assemblies has a different number, size, or arrangement of contact pins, and wherein a base component of each of the first and second modular contact assemblies comprises a pin plate through which the contact pins are received.

14. The modular electrical connector assembly kit of claim 11, wherein the header component comprises a front plate and a mating surface defined on the front plate around the first and second receptacle spaces, and wherein the mating surface is configured to be secured to the first planar surface of the first modular contact assembly and to the third planar surface of the second modular contact assembly.

15. The modular electrical connector assembly kit of claim 11, further comprising a third modular contact assembly and a third receptacle space of the header component, wherein the third modular contact assembly is configured for insertion into any of the first, second, or third receptacle spaces, wherein the third modular contact assembly has a different contact element configuration from the first and second modular contact assemblies, and wherein the desired connector configuration comprises a combination of the first, second and third modular contact assemblies.

16. A modular electrical connector, comprising:

a header component having a first receptacle space defined by a first box-shaped receptacle comprising a plurality of projecting walls and a second receptacle space defined by a second box-shaped receptacle comprising a plurality of projecting walls;

a first modular contact assembly fitted within the first receptacle space of the header component, wherein the first modular contact assembly comprises a first pin plate having a first planar surface and a second planar surface, wherein the first planar surface is parallel to the second planar surface, and wherein a first plurality of contact elements extends through both the first planar surface and the second planar surface of the first modular contact assembly; and a second modular contact assembly fitted within the second receptacle space of the header component, wherein the second modular contact assembly comprises a second pin plate having a third planar surface and a fourth planar surface, wherein the third planar surface is parallel to the fourth planar surface, and wherein a second plurality of contact elements extends through both the third planar surface and the fourth planar surface of the second modular contact assembly, wherein the first modular contact assembly and the second modular contact assembly are secured to a mating surface of the header component and together form a single final connector having a desired contact pattern that is configured to receive a single corresponding connector.

17. The modular electrical connector of claim 16, wherein the first and second modular contact assemblies have a same number, size, and arrangement of contact elements, and wherein each of the first and second receptacle spaces has a common perimeter size.

18. The modular electrical connector of claim 16, wherein the header component is an insulated component that is electrically insulated from the first and second modular contact assemblies, and wherein contacts of one of the first or second modular contact assemblies are surrounded by one of the first box-shaped receptacle and the second box-shaped receptacle of the header component.

19. The modular electrical connector of claim 16, wherein the first plurality of pins extend outward from a center of the first modular contact assembly.

20. The modular electrical connector of claim 16, wherein the second plurality of pins extend outward from a center of the first modular contact assembly.

21. The method of claim 1, wherein a combination of the first modular contact assembly and the second modular contact assembly creates a single final connector that is configured to receive a single corresponding connector.

22. The method of claim 1, wherein the header component defines a perimeter of the first receptacle space and a perimeter of the second receptacle space, and wherein inserting the first modular contact assembly into the first receptacle space comprises inserting the first modular contact assembly such that projecting walls of the first box-shaped receptacle enclose a perimeter of the first modular contact assembly within the first receptacle.

23. The method of claim 1, wherein the header component consists of a single piece.

* * * * *